US010615493B2

(12) United States Patent
Huang et al.

(10) Patent No.: US 10,615,493 B2
(45) Date of Patent: Apr. 7, 2020

(54) ANTENNA STRUCTURE

(71) Applicant: Wistron NeWeb Corp., Hsinchu (TW)

(72) Inventors: Chun-Lin Huang, Hsinchu (TW); Chien-Ting Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/543,824

(22) Filed: Aug. 19, 2019

(65) Prior Publication Data

US 2020/0083599 A1 Mar. 12, 2020

(30) Foreign Application Priority Data

Sep. 7, 2018 (TW) ..... 107131518 A

(51) Int. Cl.

| | |
|---|---|
| ***H01Q 5/50*** | (2015.01) |
| ***H01Q 1/22*** | (2006.01) |
| ***H01Q 9/04*** | (2006.01) |
| ***H01Q 1/48*** | (2006.01) |
| ***H01Q 1/36*** | (2006.01) |

(52) U.S. Cl.

CPC ..... *H01Q 1/36* (2013.01); *H01Q 1/22* (2013.01); *H01Q 5/50* (2015.01); *H01Q 9/0407* (2013.01); *H01Q 1/48* (2013.01)

(58) Field of Classification Search

CPC .. H01Q 1/36; H01Q 5/50; H01Q 1/22; H01Q 1/48; H01Q 5/30; H01Q 5/364; H01Q 5/357; H01Q 5/371; H01Q 9/0407; H01Q 9/0442

See application file for complete search history.

(56) References Cited

U.S. PATENT DOCUMENTS

| | | | | |
|---|---|---|---|---|
| 7,907,091 | B2 * | 3/2011 | Zhang | H01Q 1/38 343/700 MS |
| 9,755,307 | B2 | 9/2017 | Chi et al. | |
| 2002/0175861 | A1 * | 11/2002 | Lin | H01Q 1/243 343/700 MS |

(Continued)

FOREIGN PATENT DOCUMENTS

| | | | |
|---|---|---|---|
| CN | 106329129 | A | 1/2017 |
| TW | 2015/09000 | A | 3/2015 |
| WO | 2018/120593 | A1 | 7/2018 |

*Primary Examiner* — Dameon E Levi
*Assistant Examiner* — Jennifer F Hu
(74) *Attorney, Agent, or Firm* — McClure, Qualey & Rodack, LLP

(57) ABSTRACT

An antenna structure includes a ground plane, a dielectric substrate, a first radiation element, a second radiation element, a third radiation element, and a fourth radiation element. The first radiation element is coupled to a signal source. Both the third radiation element and the fourth radiation element are coupled between the first radiation element and the second radiation element. The third radiation element has a first notch and a second notch. The fourth radiation element has a third notch and a fourth notch. A loop structure is formed by the first radiation element, the second radiation element, the third radiation element, and the fourth radiation element. A fifth notch is formed between the first radiation element and the third radiation element. A sixth notch is formed between the first radiation element and the fourth radiation element.

20 Claims, 5 Drawing Sheets

(56) References Cited

U.S. PATENT DOCUMENTS

| | | | | |
|---|---|---|---|---|
| 2003/0164798 | A1* | 9/2003 | Nevermann | H01Q 1/243 343/700 MS |
| 2008/0231531 | A1* | 9/2008 | Wang | H01Q 1/243 343/767 |
| 2010/0039343 | A1 | 2/2010 | Uno et al. | |
| 2011/0006950 | A1* | 1/2011 | Park | H01Q 9/0407 343/700 MS |

* cited by examiner

ANTENNA STRUCTURE

CROSS REFERENCE TO RELATED APPLICATIONS

This application claims priority of Taiwan Patent Application No. 107131518 filed on Sep. 7, 2018, the entirety of which is incorporated by reference herein.

BACKGROUND OF THE INVENTION

Field of the Invention

The disclosure generally relates to an antenna structure, and more particularly, it relates to a high-gain antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements in the field of wireless communication. If an antenna for signal reception or transmission does not have sufficient gain, the communication quality of related device may be degraded. Therefore, it has become a critical challenge for antenna engineers to design high-gain antenna elements.

BRIEF SUMMARY OF THE INVENTION

In an exemplary embodiment, the disclosure is directed to an antenna structure including a ground plane, a dielectric substrate, a first radiation element, a second radiation element, a third radiation element, and a fourth radiation element. The dielectric substrate has a first surface and a second surface. The second surface of the dielectric substrate is adjacent to the ground plane. The first radiation element is coupled to a signal source. The third radiation element is coupled between the first radiation element and the second radiation element. The third radiation element has a first notch and a second notch. The fourth radiation element is coupled between the first radiation element and the second radiation element. The fourth radiation element has a third notch and a fourth notch. The first radiation element, the second radiation element, the third radiation element, and the fourth radiation element are disposed on the first surface of the dielectric substrate. A loop structure is formed by the first radiation element, the second radiation element, the third radiation element, and the fourth radiation element. A fifth notch is formed between the first radiation element and the third radiation element. A sixth notch is formed between the first radiation element and the fourth radiation element. A seventh notch is formed between the second radiation element and the third radiation element. An eighth notch is formed between the second radiation element and the fourth radiation element.

In some embodiments, each of the first radiation element, the second radiation element, the third radiation element, and the fourth radiation element has a first edge and a third edge opposite to each other, and a second edge and a fourth edge opposite to each other.

In some embodiments, a first distance is defined between the first edge of the first radiation element and the third edge of the second radiation element, or is defined between the second edge of the third radiation element and the fourth edge of the fourth radiation element. The first distance is calculated according to the following equation:

$$D_1 = \left(\frac{c}{f_1 \cdot \sqrt{\varepsilon_e}}\right)^3 \cdot \frac{k}{100 \cdot h^2}$$

where "$D_1$" represents the first distance, "c" represents a speed of light, "$f_1$" represents a central frequency of the first frequency band, "$\varepsilon_e$" represents an effective dielectric constant from about 1 to about 1.3, "k" represents a first compensation constant from about 0.1 to about 0.5, and "h" represents a distance between the first surface and the ground plane.

In some embodiments, a second distance is defined between the first edge and the third edge of the first radiation element, or is defined between the first edge and the third edge of the second radiation element. The second distance is calculated according to the following equation:

$$D_2 = \left(\frac{c}{f_2 \cdot \sqrt{\varepsilon_e}}\right)^3 \cdot \frac{k}{100 \cdot h^2}$$

where "$D_2$" represents the second distance, "c" represents a speed of light, "$f_2$" represents a central frequency of the second frequency band, "$\varepsilon_e$" represents an effective dielectric constant from about 1 to about 1.3, "k" represents a first compensation constant from about 0.1 to about 0.5, and "h" represents a distance between the first surface and the ground plane.

In some embodiments, the length of the first matching branch is calculated according to the following equation:

$$M_1 = \frac{c \cdot m}{8 \cdot f_1 \cdot \sqrt{\varepsilon_e}}$$

where "$M_1$" represents the length of the first matching branch, "c" represents a speed of light, "$f_1$" represents a central frequency of the first frequency band, "$\varepsilon_e$" represents an effective dielectric constant from about 1 to about 1.3, and "m" represents a second compensation constant from about 1 to about 1.5.

In some embodiments, the length of the second matching branch is calculated according to the following equation:

$$M_2 = \frac{c \cdot m}{8 \cdot f_2 \cdot \sqrt{\varepsilon_e}}$$

where "$M_2$" represents the length of the second matching branch, "c" represents a speed of light, "$f_2$" represents a central frequency of the second frequency band, "$\varepsilon_e$" represents an effective dielectric constant from about 1 to about 1.3, and "m" represents a second compensation constant from about 1 to about 1.5.

In some embodiments, a third distance is defined between the first edge and the third edge of the third radiation element, or is defined between the first edge and the third edge of the fourth radiation element. The third distance is calculated according to the following equation:

$$D_3 = \frac{c \cdot m}{2 \cdot f_2 \cdot \sqrt{\varepsilon_e}}$$

where "$D_3$" represents the third distance, "c" represents a speed of light, "$f_2$" represents a central frequency of the second frequency band, "$\varepsilon_e$" represents an effective dielectric constant from about 1 to about 1.3, and "m" represents a second compensation constant from about 1 to about 1.5.

In some embodiments, a fourth distance is defined between the second slot and the first edge of the first radiation element, or is defined between the third slot and the first edge of the first radiation element. The fourth distance is calculated according to the following equation:

$$D_4 = \left(\frac{c}{f_1 \cdot \sqrt{\varepsilon_e}}\right)^3 \cdot \frac{k}{200 \cdot h^2}$$

where "$D_4$" represents the fourth distance, "c" represents a speed of light, "$f_1$" represents a central frequency of the first frequency band, "$\varepsilon_e$" represents an effective dielectric constant from about 1 to about 1.3, "k" represents a first compensation constant from about 0.1 to about 0.5, and "h" represents a distance between the first surface and the ground plane.

In some embodiments, the notch length of each of the first notch, the second notch, the third notch, the fourth notch, the fifth notch, the sixth notch, the seventh notch, and the eighth notch is calculated according to the following equation:

$$S_L = \frac{c}{24 \cdot f_2 \cdot \sqrt{\varepsilon_e}}$$

where "$S_L$" represents the notch length, "c" represents a speed of light, "$f_2$" represents a central frequency of the second frequency band, and "$\varepsilon_e$" represents an effective dielectric constant from about 1 to about 1.3.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
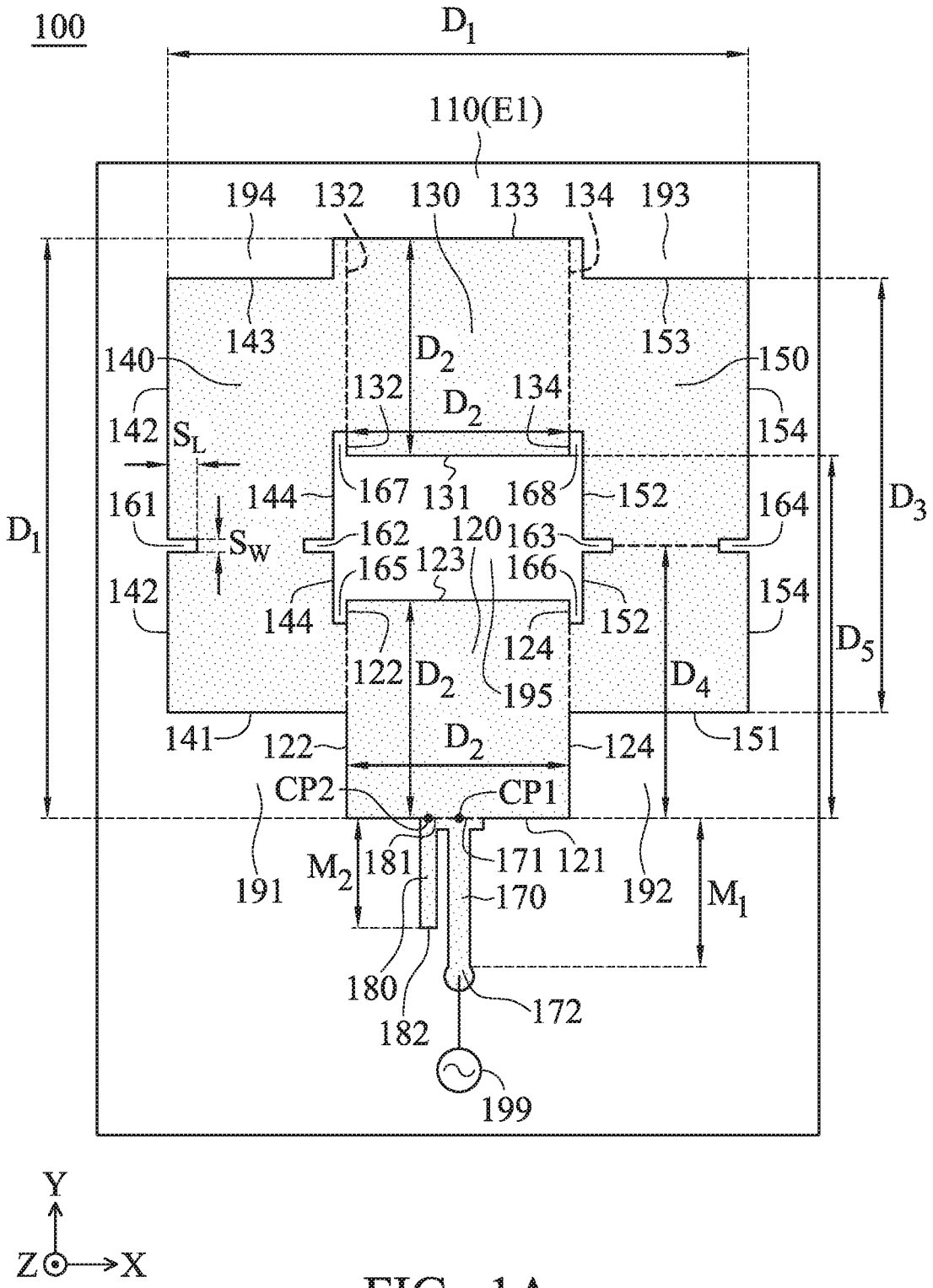
FIG. 1A is a top view of an antenna structure according to an embodiment of the invention.
Figure 1B:
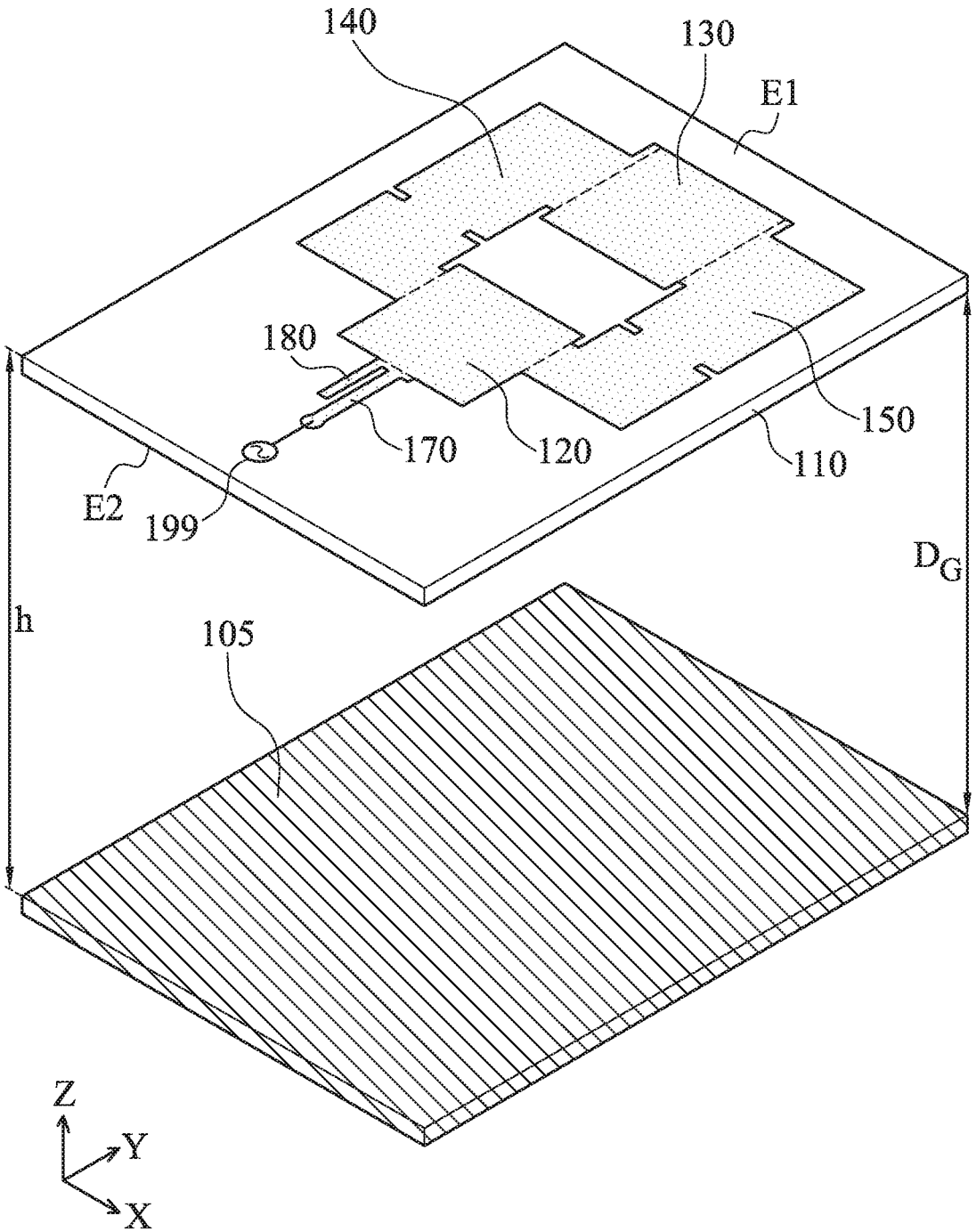
FIG. 1B is a perspective view of an antenna structure according to an embodiment of the invention.

FIG. 1A is a top view of an antenna structure 100 according to an embodiment of the invention. FIG. 1B is a perspective view of the antenna structure 100 according to an embodiment of the invention. Please refer to FIG. 1A and FIG. 1B. The antenna structure 100 may be applicable to a communication device, such as a wireless access point. As shown in FIG. 1A and FIG. 1B, the antenna structure 100 includes a ground plane 105, a dielectric substrate 110, a first radiation element 120, a second radiation element 130, a third radiation element 140, a fourth radiation element 150, a first matching branch 170, and a second matching branch 180. The ground plane 105, the first radiation element 120, the second radiation element 130, the third radiation element 140, the fourth radiation element 150, the first matching branch 170, and the second matching branch 180 may be all made of metal materials, such as copper, silver, aluminum, iron, or their alloys.

The dielectric substrate 110 may be an FR4 (Flame Retardant 4) substrate, a PCB (Printed Circuit Board), or an FCB (Flexible Circuit Board). The dielectric substrate 110 has a first surface E1 and a second surface E2 which are opposite to each other. The first radiation element 120, the second radiation element 130, the third radiation element 140, the fourth radiation element 150, the first matching branch 170, and the second matching branch 180 are all disposed on the first surface E1 of the dielectric substrate 110. The second surface E2 of the dielectric substrate 110 faces the ground plane 105, and the second surface E2 of the dielectric substrate 110 is adjacent to the ground plane 105. It should be noted that the term "adjacent" or "close" over the disclosure means that the distance (spacing) between two corresponding elements is smaller than a predetermined distance (e.g., 10 mm or shorter), or means that the two corresponding elements directly touch each other (i.e., the aforementioned distance/spacing therebetween is reduced to 0). In some embodiments, the dielectric substrate 110 and the ground plane 105 are completely separate from each other, and they are substantially parallel to each other. There is a spacing distance $D_G$ between the second surface E2 of the dielectric substrate 110 and the ground plane 105.

The first radiation element 120 is coupled to a signal source 199. For example, the signal source 199 may be an RF (Radio Frequency) module for generating a transmission signal or processing a reception signal, so as to excite the antenna structure 100. The first radiation element 120 may substantially have a square shape. Specifically, the first radiation element 120 has a first edge 121, a second edge 122, a third edge 123, and the fourth edge 124. The first edge 121 is opposite to the third edge 123. The second edge 122 is opposite to the fourth edge 124. The first edge 121, the second edge 122, the third edge 123, and the fourth edge 124 may substantially have the same lengths.

The second radiation element 130 may substantially have a square shape. Specifically, the second radiation element 130 has a first edge 131, a second edge 132, a third edge 133, and a fourth edge 134. The first edge 131 is opposite to the third edge 133. The second edge 132 is opposite to the fourth edge 134. The first edge 131, the second edge 132, the third edge 133, and the fourth edge 134 may substantially have the same lengths.

The third radiation element 140 is coupled between the first radiation element 120 and the second radiation element 130. The third radiation element 140 may substantially have a rectangular shape. Specifically, the third radiation element 140 has a first edge 141, a second edge 142, a third edge 143, and a fourth edge 144. The first edge 141 is opposite to the third edge 143. The second edge 142 is opposite to the fourth edge 144. The length of each of the second edge 142 and the fourth edge 144 may be greater than the length of each of the first edge 141 and the third edge 143. The fourth edge 144 of the third radiation element 140 may further extend toward the first radiation element 120 and the second radiation element 130, so as to connect the first radiation element 120 with the second radiation element 130. The third radiation element 140 has a first notch 161 and a second notch 162. The first notch 161 is positioned at the second edge 142 of the third radiation element 140. The second notch 162 is positioned at the fourth edge 144 of the third radiation element 140.

The fourth radiation element 150 is coupled between the first radiation element 120 and the second radiation element 130. The fourth radiation element 150 may substantially have a rectangular shape. Specifically, the fourth radiation element 150 has a first edge 151, a second edge 152, a third edge 153, and a fourth edge 154. The first edge 151 is opposite to the third edge 153. The second edge 152 is opposite to the fourth edge 154. The length of each of the second edge 152 and the fourth edge 154 may be greater than the length of each of the first edge 151 and the third edge 153. The fourth edge 154 of the fourth radiation element 150 may further extend toward the first radiation element 120 and the second radiation element 130, so as to connect the first radiation element 120 with the second radiation element 130. The fourth radiation element 150 has a third notch 163 and a fourth notch 164. The third notch 163 is positioned at the second edge 152 of the fourth radiation element 150. The fourth notch 164 is positioned at the fourth edge 154 of the fourth radiation element 150.

In addition, a fifth notch 165 is formed between the first radiation element 120 and the third radiation element 140. A sixth notch 166 is formed between the first radiation element 120 and the fourth radiation element 150. A seventh notch 167 is formed between the second radiation element 130 and the third radiation element 140. An eighth notch 168 is formed between the second radiation element 130 and the fourth radiation element 150. Specifically, the fifth notch 165 is positioned between the second edge 122 of the first radiation element 120 and the fourth edge 144 of the third radiation element 140. The sixth notch 166 is positioned between the fourth edge 124 of the first radiation element 120 and the second edge 152 of the fourth radiation element 150. The seventh notch 167 is positioned between the second edge 132 of the second radiation element 130 and the fourth edge 144 of the third radiation element 140. The eighth notch 168 is positioned between the fourth edge 134 of the second radiation element 130 and the second edge 152 of the fourth radiation element 150. In some embodiments, each of the first notch 161, the second notch 162, the third notch 163, the fourth notch 164, the fifth notch 165, the sixth notch 166, the seventh notch 167, and the eighth notch 168 substantially has a straight-line shape. Each notch may be considered as a monopole slot having an open end and a closed end. The incorporation of the aforementioned eight notches can fine-tune the current distribution on the antenna structure 100, thereby increasing the directivity of the antenna structure 100.

Generally, the second edge 132 of the second radiation element 130 is coupled through the third radiation element 140 to the second edge 122 of the first radiation element 120, and the fourth edge 134 of the second radiation element 130 is coupled through the fourth radiation element 150 to the fourth edge 124 of the first radiation element 120, such that a loop structure is formed by the first radiation element 120, the second radiation element 130, the third radiation element 140, and the fourth radiation element 150. A hollow portion 195 of the loop structure may be substantially have a rectangular shape, and it may be completely surrounded by the third edge 123 of the first radiation element 120, the first edge 131 of the second radiation element 130, the fourth edge 144 of the third radiation element 140, and the second edge 152 of the fourth radiation element 150.

In some embodiments, a first corner notch region 191 is formed and adjacent to the second edge 122 of the first radiation element 120 and the first edge 141 of the third radiation element 140. A second corner notch region 192 is formed and adjacent to the fourth edge 124 of the first radiation element 120 and the first edge 151 of the fourth radiation element 150. A third corner notch region 193 is formed and adjacent to the fourth edge 134 of the second radiation element 130 and the third edge 153 of the fourth radiation element 150. A fourth corner notch region 194 is formed and adjacent to the second edge 132 of the second radiation element 130 and the third edge 143 of the third radiation element 140. Each of the first corner notch region 191, the second corner notch region 192, the third corner notch region 193, and the fourth corner notch region 194 may substantially have a rectangular shape. The area of each of the first corner notch region 191 and the second corner notch region 192 may be greater than the area of each of the third corner notch region 193 and the fourth corner notch region 194.

The first matching branch 170 may substantially have a relatively-long straight-line shape. The signal source 199 is coupled through the first matching branch 170 to a first connection point CP1 on the first edge 121 of the first radiation element 120. The first matching branch 170 has a first end 171 and a second end 172. The first end 171 of the first matching branch 170 is coupled to the first connection point CP1. The second end 172 of the first matching branch 170 is coupled to the signal source 199. The second matching branch 180 may substantially have a relatively-short straight-line shape. The second matching branch 180 has a first end 181 and a second end 182. The first end 181 of the second matching branch 180 is coupled to a second connection point CP2 on the first edge 121 of the first radiation element 120. The second end 182 of the second matching branch 180 is an open end. It should be noted that the first matching branch 170 may be substantially parallel to the second matching branch 180, and the second connection point CP2 may be different from the first connection point CP1.

According to practical measurements, the antenna structure 100 can cover a first frequency band and a second frequency band. The first frequency band may be from about 2400 MHz to about 2500 MHz. The second frequency band may be from about 5150 MHz to about 5850 MHz. Therefore, the antenna structure 100 can support at least the wideband operations of Bluetooth and WLAN (Wireless Local Area Network) 2.4 GHz/5 GHz. It should be noted that the above frequency ranges are adjustable according to different requirements. In alternative embodiments, the antenna structure 100 can cover a GPS (Global Positioning System) frequency band or an LTE (Long Term Evolution) frequency band, but it is not limited thereto.

With respect to the antenna theory, the first radiation element 120, the second radiation element 130, the third radiation element 140, and the fourth radiation element 150 are excited to generate the aforementioned first frequency band. The first radiation element 120 and the second radiation element 130 are excited to generate the aforementioned second frequency band. Specifically, when the antenna structure 100 operates in the aforementioned first frequency band, the surface currents on the first radiation element 120, the second radiation element 130, the third radiation element 140, and the fourth radiation element 150 all flow in a first direction (e.g., the direction of +Y-axis); when the antenna structure 100 operates in the aforementioned second frequency band, the surface currents on the first radiation element 120 and the second radiation element 130 all flow in a second direction (e.g., the direction of −Y-axis), which is opposite to the first direction. Therefore, the design of the antenna structure 100 can gather the surface currents thereon, so as to increase the directivity of the radiation pattern thereof.

Figure 2A:
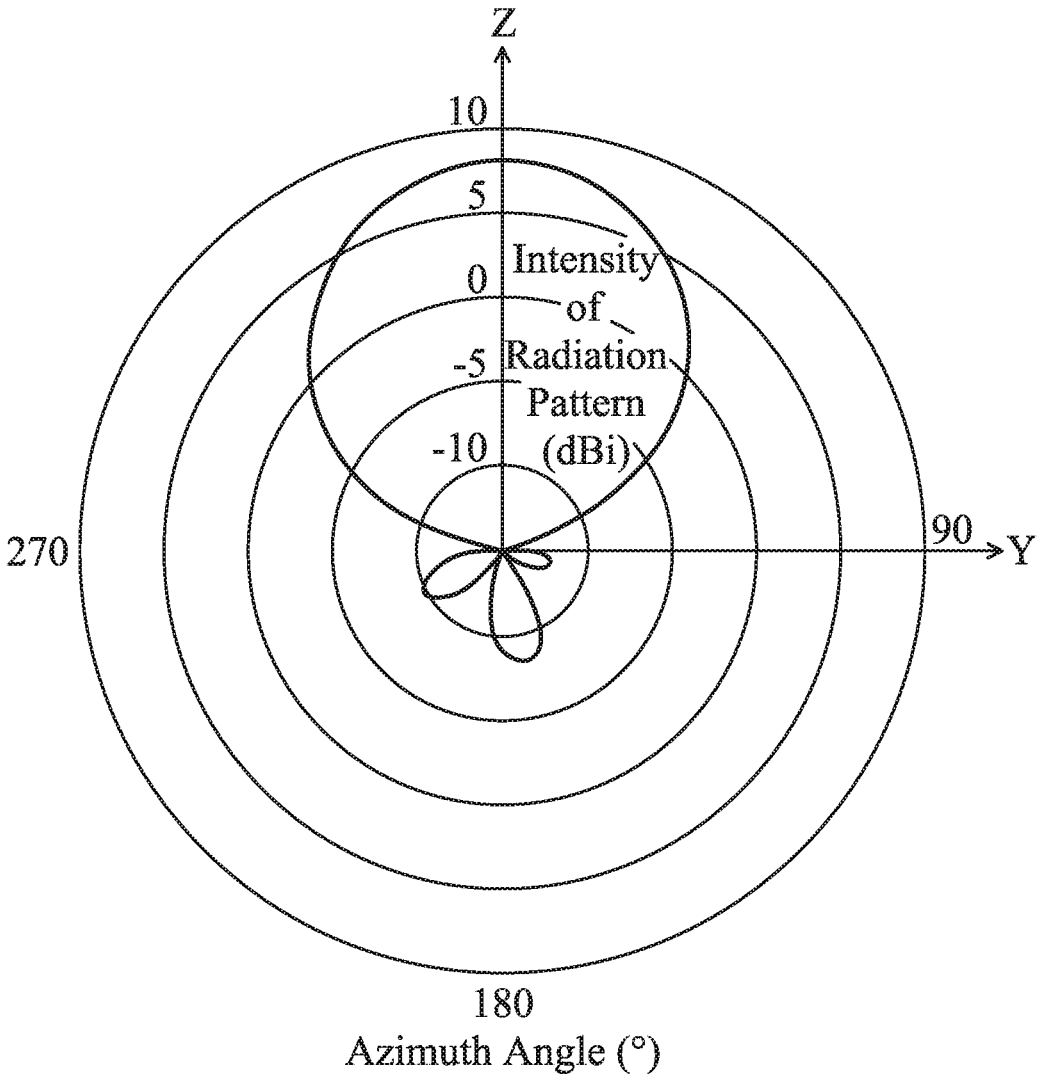
FIG. 2A is a radiation pattern of an antenna structure within a first frequency band according to an embodiment of the invention.
Figure 2B:
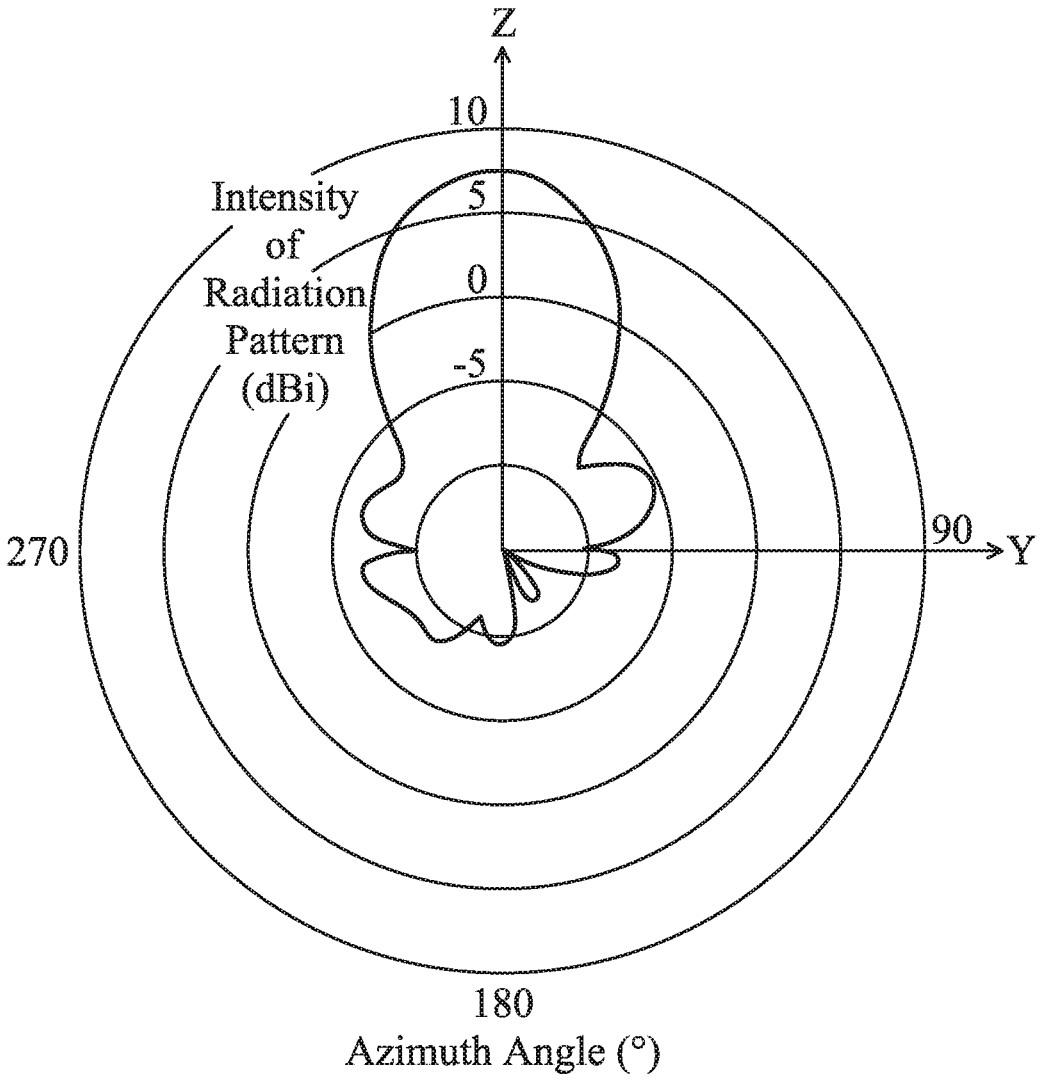
FIG. 2B is a radiation pattern of an antenna structure within a second frequency band according to an embodiment of the invention.

FIG. 2A is a radiation pattern of the antenna structure 100 within the first frequency band according to an embodiment of the invention. FIG. 2B is a radiation pattern of the antenna structure 100 within the second frequency band according to an embodiment of the invention. According to the measurements of FIG. 2A and FIG. 2B, within both of the first frequency band and the second frequency band, the main beam of the radiation pattern of the antenna structure 100 is arranged toward the same direction (e.g., the direction of +Z-axis) and has sufficient gain (e.g., at least 7 dBi), and it can meet the requirement of practical application of general mobile communication devices.

In some embodiments, the element sizes of the antenna structure 100 are described as follows, and their units use the MKS (Meter-Kilogram-Second) system. It should be noted that the following ranges of sizes are calculated and obtained according to many experiment results, and they help to optimize the operation bandwidth and impedance matching of the antenna structure 100.

The first distance $D_1$ may be defined between the first edge 121 of the first radiation element 120 and the third edge 133 of the second radiation element 130, or the first distance $D_1$ may be defined between the second edge 142 of the third radiation element 140 and the fourth edge 154 of the fourth radiation element 150. The first distance $D_1$ may be calculated according to the equation (1):

$$D_1 = \left(\frac{c}{f_1 \cdot \sqrt{\varepsilon_e}}\right)^3 \cdot \frac{k}{100 \cdot h^2} \tag{1}$$

where "$D_1$" represents the first distance $D_1$, "c" represents the speed of light, "$f_1$" represents the central frequency of the aforementioned first frequency band, "$\varepsilon_e$" represents an effective dielectric constant from about 1 to about 1.3, "k" represents a first compensation constant from about 0.1 to about 0.5, and "h" represents a distance between the first surface E1 and the ground plane 105.

The second distance $D_2$ may be defined between the first edge 121 and the third edge 123 of the first radiation element 120, or the second distance $D_2$ may be defined between the first edge 131 and the third edge 133 of the second radiation element 130. Furthermore, the second distance $D_2$ may be defined between the second edge 122 and the fourth edge 124 of the first radiation element 120, or the second distance $D_2$ may be defined between the second edge 132 and the fourth edge 134 of the second radiation element 130. The second distance $D_2$ may be calculated according to the equation (2):

$$D_2 = \left(\frac{c}{f_2 \cdot \sqrt{\varepsilon_e}}\right)^3 \cdot \frac{k}{100 \cdot h^2} \tag{2}$$

where "$D_2$" represents the second distance $D_2$, and "$f_2$" represents the central frequency of the aforementioned second frequency band. For example, the central frequency $f_1$ of the aforementioned first frequency band may be equal to an average value of 2400 MHz and 2500 MHz (i.e., 2450 MHz), and the central frequency $f_2$ of the aforementioned second frequency band may be equal to an average value of 5150 MHz and 5850 MHz (i.e., 5500 MHz).

The length $M_1$ of the first matching branch 170 and the length $M_2$ of the second matching branch 180 may be calculated according to the equations (3) and (4):

$$M_1 = \frac{c \cdot m}{8 \cdot f_1 \cdot \sqrt{\varepsilon_e}} \tag{3}$$

$$M_2 = \frac{c \cdot m}{8 \cdot f_2 \cdot \sqrt{\varepsilon_e}} \tag{4}$$

where "$M_1$" represents the length $M_1$ of the first matching branch 170, "$M_2$" represents the length $M_2$ of the second matching branch 180, and "m" represents a second compensation constant from about 1 to about 1.5.

The third distance $D_3$ may be defined between the first edge 141 and the third edge 143 of the third radiation element 140, or the third distance $D_3$ may be defined between the first edge 151 and the third edge 153 of the fourth radiation element 150. The third distance $D_3$ may be calculated according to the equation (5):

$$D_3 = \frac{c \cdot m}{2 \cdot f_2 \cdot \sqrt{\varepsilon_e}} \tag{5}$$

where "$D_3$" represents the third distance $D_3$.

The fourth distance $D_4$ may be defined between the second slot 162 and the first edge 121 of the first radiation element 120, or the fourth distance $D_4$ may be defined between the third slot 163 and the first edge 121 of the first radiation element 120. The fourth distance $D_4$ may be calculated according to the equation (6):

$$D_4 = \left(\frac{c}{f_1 \cdot \sqrt{\varepsilon_e}}\right)^3 \cdot \frac{k}{200 \cdot h^2} \tag{6}$$

where "$D_4$" represents the fourth distance $D_4$.

The fifth distance $D_5$ may be defined between the first edge 121 of the first radiation element 120 and the first edge 131 of the second radiation element 130. The fifth distance $D_5$ may be substantially equal to the third distance $D_3$.

The notch length $S_L$ of each of the first notch 161, the second notch 162, the third notch 163, the fourth notch 164, the fifth notch 165, the sixth notch 166, the seventh notch 167, and the eighth notch 168 (i.e., the distance from the open end to the closed end of each notch) may be calculated according to the equation (7):

$$S_L = \frac{c}{24 \cdot f_2 \cdot \sqrt{\varepsilon_e}} \tag{7}$$

where "$S_L$" represents the notch length $S_L$.

The notch width $S_w$ of each of the first notch 161, the second notch 162, the third notch 163, the fourth notch 164, the fifth notch 165, the sixth notch 166, the seventh notch 167, and the eighth notch 168 may be smaller than or equal to 1 mm. The spacing distance $D_G$ between the second surface E2 of the dielectric substrate 110 and the ground plane 105 may be smaller than or equal to 6 mm.

Figure 3:
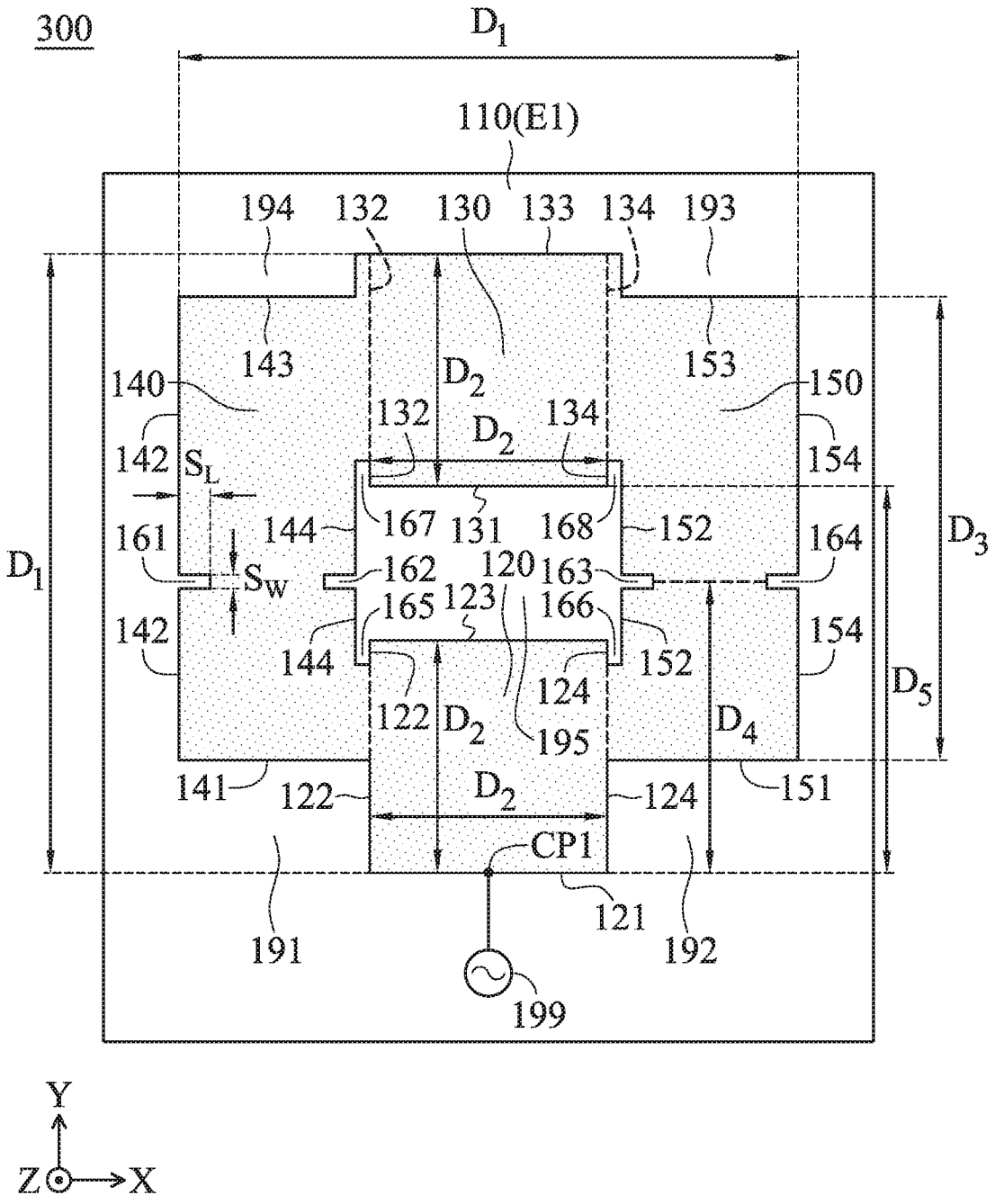
FIG. 3 is a top view of an antenna structure according to another embodiment of the invention.

FIG. 3 is a top view of an antenna structure 300 according to another embodiment of the invention. FIG. 3 is similar to FIG. 1A. In the embodiment of FIG. 3, the antenna structure 300 does not include the first matching branch 170 and the second matching branch 180, and the signal source 199 is directly coupled to the first connection point CP1. With such a design, the total size of the antenna structure 300 is further reduced. Other features of the antenna structure 300 of FIG. 3 are similar to those of the antenna structure 100 of FIG. 1. Accordingly, the two embodiments can achieve similar levels of performance.

The invention proposes a novel antenna structure. For both high and low frequency bands, the radiation pattern of the proposed antenna structure has the same maximum-gain direction, thereby effectively enhancing the antenna directivity. In comparison to the conventional design, the antenna structure of the invention has at least the advantages of high gain, low loss, thin and light structure, and low manufacturing cost, and therefore it is suitable for application in a variety of communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground plane;

a dielectric substrate, having a first surface and a second surface, wherein the second surface of the dielectric substrate is adjacent to the ground plane;

a first radiation element, coupled to a signal source;

a second radiation element;

a third radiation element, coupled between the first radiation element and the second radiation element, wherein the third radiation element has a first notch and a second notch; and a fourth radiation element, coupled between the first radiation element and the second radiation element, wherein the fourth radiation element has a third notch and a fourth notch;

wherein the first radiation element, the second radiation element, the third radiation element, and the fourth radiation element are disposed on the first surface of the dielectric substrate;

wherein a loop structure is formed by the first radiation element, the second radiation element, the third radiation element, and the fourth radiation element;

wherein a fifth notch is formed between the first radiation element and the third radiation element, a sixth notch is formed between the first radiation element and the fourth radiation element, a seventh notch is formed between the second radiation element and the third radiation element, and an eighth notch is formed between the second radiation element and the fourth radiation element.

2. The antenna structure as claimed in claim 1, wherein each of the first radiation element and the second radiation element substantially has a square shape.

3. The antenna structure as claimed in claim 1, wherein each of the third radiation element and the fourth radiation element substantially has a rectangular shape.

4. The antenna structure as claimed in claim 1, wherein each of the first notch, the second notch, the third notch, the fourth notch, the fifth notch, the sixth notch, the seventh notch, and the eighth notch substantially has a straight-line shape.

5. The antenna structure as claimed in claim 1, wherein each of the first radiation element, the second radiation element, the third radiation element, and the fourth radiation element has a first edge and a third edge opposite to each other, and a second edge and a fourth edge opposite to each other.

6. The antenna structure as claimed in claim 5, further comprising:

a first matching branch, wherein the signal source is coupled through the first matching branch to a first connection point on the first edge of the first radiation element; and a second matching branch, coupled to a second connection point on the first edge of the first radiation element;

wherein the second connection point is different from the first connection point.

7. The antenna structure as claimed in claim 6, wherein the antenna structure covers a first frequency band from about 2400 MHz to about 2500 MHz, and a second frequency band from about 5150 MHz to about 5850 MHz.

8. The antenna structure as claimed in claim 7, wherein the first radiation element, the second radiation element, the third radiation element, and the fourth radiation element are excited to generate the first frequency band, and the first radiation element and the second radiation element are excited to generate the second frequency band.

9. The antenna structure as claimed in claim 7, wherein a first distance is defined between the first edge of the first radiation element and the third edge of the second radiation element, or is defined between the second edge of the third radiation element and the fourth edge of the fourth radiation element, and the first distance is calculated according to the following equation:

$$D_1 = \left(\frac{c}{f_1 \cdot \sqrt{\varepsilon_e}}\right)^3 \cdot \frac{k}{100 \cdot h^2}$$

where "$D_1$" represents the first distance, "c" represents a speed of light, "$f_1$" represents a central frequency of the first frequency band, "$\varepsilon_e$" represents an effective dielectric constant from about 1 to about 1.3, "k" represents a first compensation constant from about 0.1 to about 0.5, and "h" represents a distance between the first surface and the ground plane.

10. The antenna structure as claimed in claim 7, wherein a second distance is defined between the first edge and the third edge of the first radiation element, or is defined between the first edge and the third edge of the second radiation element, and the second distance is calculated according to the following equation:

$$D_2 = \left(\frac{c}{f_2 \cdot \sqrt{\varepsilon_e}}\right)^3 \cdot \frac{k}{100 \cdot h^2}$$

where "$D_2$" represents the second distance, "c" represents a speed of light, "$f_2$" represents a central frequency of the second frequency band, "$\varepsilon_e$" represents an effective dielectric constant from about 1 to about 1.3, "k" represents a first compensation constant from about 0.1 to about 0.5, and "h" represents a distance between the first surface and the ground plane.

11. The antenna structure as claimed in claim 7, wherein a length of the first matching branch is calculated according to the following equation:

$$M_1 = \frac{c \cdot m}{8 \cdot f_1 \cdot \sqrt{\varepsilon_e}}$$

where "$M_1$" represents the length of the first matching branch, "c" represents a speed of light, "$f_1$" represents a central frequency of the first frequency band, "$\varepsilon_e$" represents an effective dielectric constant from about 1 to about 1.3, and "m" represents a second compensation constant from about 1 to about 1.5.

12. The antenna structure as claimed in claim 7, wherein a length of the second matching branch is calculated according to the following equation:

$$M_2 = \frac{c \cdot m}{8 \cdot f_2 \cdot \sqrt{\varepsilon_e}}$$

where "$M_2$" represents the length of the second matching branch, "c" represents a speed of light, "$f_2$" represents a central frequency of the second frequency band, "$\varepsilon_e$" represents an effective dielectric constant from about 1 to about 1.3, and "m" represents a second compensation constant from about 1 to about 1.5.

13. The antenna structure as claimed in claim 7, wherein a third distance is defined between the first edge and the third edge of the third radiation element, or is defined between the first edge and the third edge of the fourth radiation element, and the third distance is calculated according to the following equation:

$$D_3 = \frac{c \cdot m}{2 \cdot f_2 \cdot \sqrt{\varepsilon_e}}$$

where "$D_3$" represents the third distance, "c" represents a speed of light, "$f_2$" represents a central frequency of the second frequency band, "$\varepsilon_e$" represents an effective dielectric constant from about 1 to about 1.3, and "m" represents a second compensation constant from about 1 to about 1.5.

14. The antenna structure as claimed in claim 13, wherein a fifth distance is defined between the first edge of the first radiation element and the first edge of the second radiation element, and the fifth distance is substantially equal to the third distance.

15. The antenna structure as claimed in claim 7, wherein a fourth distance is defined between the second slot and the first edge of the first radiation element, or is defined between the third slot and the first edge of the first radiation element, and the fourth distance is calculated according to the following equation:

$$D_4 = \left(\frac{c}{f_1 \cdot \sqrt{\varepsilon_e}}\right)^3 \cdot \frac{k}{200 \cdot h^2}$$

where "$D_4$" represents the fourth distance, "c" represents a speed of light, "$f_1$" represents a central frequency of the first frequency band, "$\varepsilon_e$" represents an effective dielectric constant from about 1 to about 1.3, "k" represents a first compensation constant from about 0.1 to about 0.5, and "h" represents a distance between the first surface and the ground plane.

16. The antenna structure as claimed in claim 7, wherein a notch length of each of the first notch, the second notch, the third notch, the fourth notch, the fifth notch, the sixth notch, the seventh notch, and the eighth notch is calculated according to the following equation:

$$S_L = \frac{c}{24 \cdot f_2 \cdot \sqrt{\varepsilon_e}}$$

where "$S_L$" represents the notch length, "c" represents a speed of light, "$f_2$" represents a central frequency of the second frequency band, and "$\varepsilon_e$" represents an effective dielectric constant from about 1 to about 1.3.

17. The antenna structure as claimed in claim 5, wherein the second edge of the second radiation element is coupled through the third radiation element to the second edge of the first radiation element, and the fourth edge of the second radiation element is coupled through the fourth radiation element to the fourth edge of the first radiation element.

18. The antenna structure as claimed in claim 5, wherein the first notch is positioned at the second edge of the third radiation element, the second notch is positioned at the fourth edge of the third radiation element, the third notch is positioned at the second edge of the fourth radiation element, and the fourth notch is positioned at the fourth edge of the fourth radiation element.

19. The antenna structure as claimed in claim 5, wherein the fifth notch is positioned between the second edge of the first radiation element and the fourth edge of the third radiation element, the sixth notch is positioned between the fourth edge of the first radiation element and the second edge of the fourth radiation element, the seventh notch is positioned between the second edge of the second radiation element and the fourth edge of the third radiation element, and the eighth notch is positioned between the fourth edge of the second radiation element and the second edge of the fourth radiation element.

20. The antenna structure as claimed in claim 1, wherein a notch width of each of the first notch, the second notch, the third notch, the fourth notch, the fifth notch, the sixth notch, the seventh notch, and the eighth notch is smaller than or equal to 1 mm.

* * * * *